US008651655B2

(12) United States Patent
Olson et al.

(10) Patent No.: US 8,651,655 B2
(45) Date of Patent: Feb. 18, 2014

(54) PRINTER

(75) Inventors: Allan G. Olson, Bremerton, WA (US); Anyee J. Worley, Escondido, CA (US); Michael L. Gustafson, Escondido, CA (US); Michael J. Allison, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 188 days.

(21) Appl. No.: 13/171,777

(22) Filed: Jun. 29, 2011

(65) Prior Publication Data

US 2013/0002778 A1 Jan. 3, 2013

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

| | | | | |
|---|---|---|---|---|
| 5,784,680 | A | 7/1998 | Taruki | |
| 5,791,645 | A | 8/1998 | Takada | |
| 7,516,958 | B2 | 4/2009 | Tu | |
| 7,522,871 | B2 | 4/2009 | Tu | |
| 2004/0061761 | A1 * | 4/2004 | Ogura et al. | 347/104 |
| 2010/0156025 | A1 * | 6/2010 | Taguchi | 271/3.19 |
| 2010/0276871 | A1 * | 11/2010 | Mizuno | 271/225 |

* cited by examiner

*Primary Examiner* — Stephen Meier
*Assistant Examiner* — Alexander C Witkowski

(57) ABSTRACT

Printer, comprising a media path that in one embodiment is arranged so that a print height is lower than a highest point of the media path.

5 Claims, 5 Drawing Sheets

PRINTER

BACKGROUND

Most printers have one or more media drive components for driving the media for printing. The media drive components drive the media along a media path. Most printers have a print head carrier structure for carrying a print head that prints on the media. Some printers use replaceable print heads, and some printers have pre-assembled or fixed print heads, for example page wide arrays or scanning print heads. Most printers also have a media input for placing the media for picking up and/or guiding the media to the media path.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
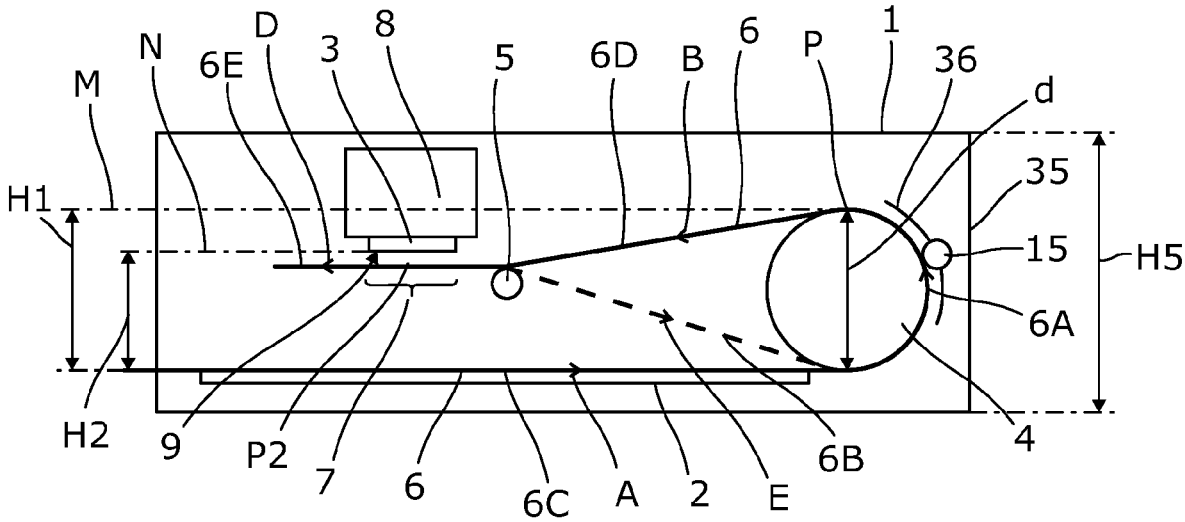
FIG. 1 shows a diagram of an example of a printer in a cross sectional side view.

FIG. 1 shows an example of a printer 1. In the shown example, the printer 1 includes a print head 3. For example, the print head 3 may be a replaceable or a fixed print head 3. For example, the print head 3 includes fluid ejection nozzle plate 9 for ejecting fluid onto media. For example, the print head 3 includes thermal or piezo resistors to trigger fluid ejection. An example fluid includes ink. The printer 1 for example comprises an inkjet printer, for example of a type suitable to be placed on a desktop, table, shelve, or the like.

The printer 1 includes a media input 2 for receiving media. The media input 2 may be tray shaped for supporting media. An example media input 2 is arranged to support and input media sheets that include letter-sized and/or A4 sized media sheets. In the shown orientation of the printer 1, the input 2 supports the media in an orientation approximately parallel to a surface of a respective table, desktop, shelve or the like on which the printer 1 is placed. It is noted that also other orientations of the printer 1 could be suitable, for example the printer 1 could be placed on its side or on its rear so that the supported media would extend approximately perpendicular to the surface of the respective table, desktop, shelve or the like.

The printer 1 includes media drive components for advancing the media. The media drive components may be arranged to pick up, separate, advance and turn the media for single side and/or duplex printing. The media drive components may pick up the media from the media input 2 for advancing the media along a media path 6. In the shown example the media drive components include a turn roller 4 and a guide wheel 5. Also, at least one pinch wheel 15 and/or turn wall 36 may be provided for pinching and/or bending the media along the turn wheel 4. The media drive components, including the turn roller 4, are integral parts of the printer 1, arranged within the printer housing 35.

The turn roller 4 may be arranged to turn the incoming media over a media turn path 6A. For example, the turn roller 4 defines the media turn path 6A. The media turn path 6A is a portion of the full media path 6. In an example, the turn roller 4 is arranged to turn the incoming media over an angle of more than 180°, with respect to the media orientation in the media input 2, in an approximately opposite advance direction B with respect to an input direction A. In an example, the turn roller 4 is arranged to turn the media over more than 181°, or over more than approximately 190°, and for example less than approximately 235°.

In operation, the media may be advanced over a down slope portion 6D of the media path 6, after having passed a highest point P of the media path 6. In the shown example, the highest point P is located in the media turn path 6A. The highest point P may determine a total height H2 of the media path, as measured between the media input 2 and the highest point P. In the shown example, the highest point P of the entire media path 6 is defined by the highest point of the turn roller 4. In the shown example, after the highest point P the media is moved downwards over the media down slope portion 6D for printing. In the shown example, the nozzle plate 9 extends at a lower plane N than the highest point P of the media path 6, for printing onto the media at a position P2 below said highest point P. The print position P2 extends in the print zone 7.

In one example, a diameter d of the turn roller 4 is relatively small. For example, the diameter d of the turn roller 4 is chosen so that different suitable media types can be turned by the turn roller 4 without damaging the media. For example, suitable media types may include paper and/or photo media, having weights of approximately 300 gram/meter$^2$ or less, or between approximately 80 and approximately 300 gram/m$^2$. Suitable media types may include letter-, card-, A4-, A3-, A5- and/or A1-sized paper, and/or media having a size within that range or larger. For example, suitable media may include paper having dimensions such as approximately 22×28 centimeters or smaller, or approximately 28×44 centimeters or smaller, including approximately 3×5 inch, approximately 4×6 inch and/or approximately 8×11.69 inch. In an example, the printer 1 may be arranged to process and print these example media types and/or other media types, for example of other standards, dimensions and/or weights. For example, the printer 1 may be arranged to process larger format media types. Consequently, different components of the printer 1 may be adapted to be suitable for predetermined media types.

In one example, the diameter d may be of a minimum or close to a minimum size that is however large enough to allow turning of photo media over the turn path 6A without damage. In a further example, the diameter d of the turn roller 4 is chosen so that the force needed to bend and turn the media is acceptable. An example diameter d of the turn roller 4 is between approximately 2 centimeters and approximately 5 centimeters, or between approximately 3 and approximately 4.4 centimeters. An example of a turn roller 4 has a diameter d of approximately 38.5 millimeters.

The example media path 6 extends from the media input 2 along the turn roller 4, towards and passed the print zone 7. In a further example, the media path includes a duplex media path portion 6B for printing on an opposite side of the media. In such example, the guide wheel 5 may be arranged to reverse the media direction D, E, towards the duplex media path portion 6B. During printing the media advance direction D may be towards the media output. In the duplex media path portion 6B the media advance direction E may be towards the turn roller 4. The guide wheel 5 may be arranged to advance the respective media towards the turn roller 4, after it has been printed by the print head 3. In this example the turn roller 4 also functions as duplex roller. The guide wheel 5 may automatically reverse the media towards the turn roller 4 for automatic duplex printing, wherein no user or operator intervention is needed for printing a second face of the media. Also suitable types of reverse mechanisms other than guide wheels 5 may be applied for automatically reversing the media for duplex printing.

In the shown example the media path 6 of the printer 1 contains, respectively, a media input path portion 6C, a media turn path 6A, a media down slope portion 6D, a print zone 7, a media duplex path portion 6B, and a media output portion 6E. In the shown example, the media input path portion 6C is at least partially defined by the media input 2. The media turn path 6A connects to the media input path portion 6C and is in one example at least partially defined by the turn roller 4. The media down slope portion 6D connects to the media turn path 6A and may be at least partially defined by the turn roller 4 and/or the guide wheel 5 and/or further guide structures. The print zone 7 may connect to the media down slope portion 6D. The print zone 7 may be defined by the position of the nozzles of the print head nozzle plate 9. A media output path portion 6E extends after the print zone 7 for outputting the printed media. In an example the media output direction, for outputting printed media, is approximately opposite to the media input direction, for inputting media in the media input 2. For example, the media output is turned at between approximately 160 and 200° with respect to the media input. The media duplex path portion 6B may be at least partially be defined by the turn roller 4. For duplex printing, the media turn path 6A may be at least partly the same as for simplex printing, for example for at least 90°. In the shown example, the media turn path 6A is the same for simplex and duplex printing between the first and second pinch wheels 15, 18. Also, the same down slope portion 6D, the same print zone 7 and the same media output path portion 6E may be used for duplex and simplex printing.

In the shown example, the printer 1 includes a print head carrier structure 8. In one example, the print head carrier structure 8 comprises a cradle for receiving a consumable or replaceable print head. Such consumable or replaceable print head may include a fluid reservoir and the print head 3. In another example, the print head 3 may be separate from the reservoir, for being consumed at a lower frequency than the reservoir, or may be fixed to the printer 1. The printer 1 may comprise a scan axis for scanning the print head 3 across the media for printing, wherein in operation the media may stepwise advance under the print head 3 for printing. In another example, the print head 3 forms a page wide array (PWA) print head and the print head carrier structure 8 comprises a frame or other suitable construction for fixedly supporting the page wide array print head, wherein in operation the media may advances continuously under the print head 3. For example, the maximum width of the print zone 7 may approximately correspond to the length of the scan axis, or the length of the PWA. For example, the maximum width of the print zone 7, and consequently the length of the scan axis or PWA may be at least approximately 20 centimeter.

In an example, the print head carrier structure 8 is arranged so that a height H1 of the print head nozzle plate 9, as measured with respect to the media input 2, is lower than a height H2 of the highest point P of the media turn path 6A. For example, if a first virtual plane N is drawn through the mouths of the nozzles of the nozzle plate 9, and a second virtual plane M is drawn through the highest point P, wherein the second virtual plane M extends parallel to the first virtual plane N, then the first virtual plane N extends between the second virtual plan M and the media input 2.

In one example the height H5 of the printer 1, between its bottom and top surface, may be approximately 4 inch (10.16 cm), or for example approximately 4.5 inch (11.43 cm) or less.

Figure 2:
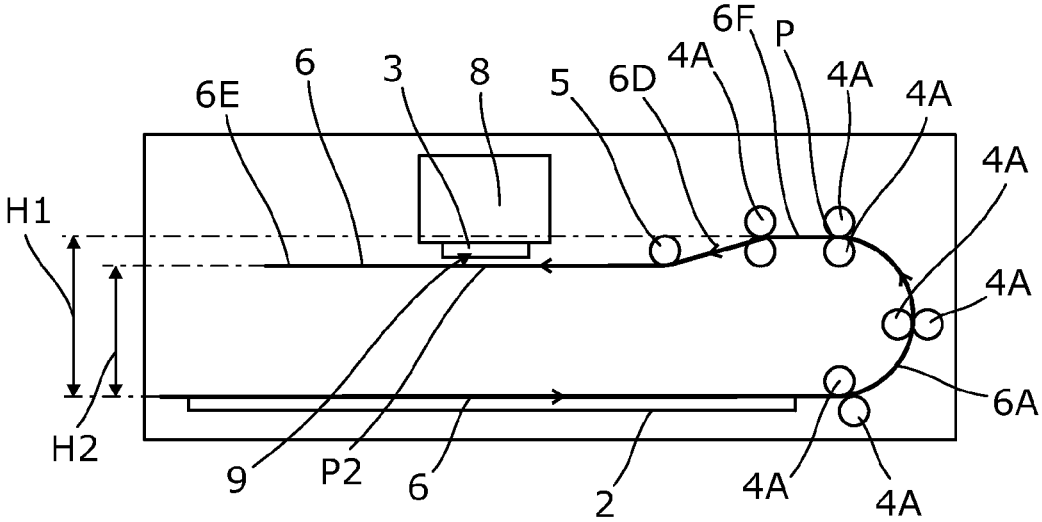
FIG. 2 shows a diagram of another example of a printer in a cross sectional side view.

For the purpose of illustration, FIG. 2 shows another example printer 1 which shows different media drive components. Here the media turn path 6A is defined by a plurality of turn rollers 4A, instead of one relatively large turn roller 4 as shown in FIG. 1. For example, the media turn path 6A turns the media over an angle of approximately 180°. The media turn path 6 includes an intermediate straight media path portion 6F between the media turn path 6A and the media down slope portion 6D. The entire media path 6 may or may not include a duplex path portion 6B. The print head carrier structure 8 is arranged so that a height H1 of the print head nozzle plate 9, as measured with respect to the media input 2, is lower than a height H2 of the highest point P of the media path 6. The printer 1 prints at a lower position P2 than the highest point P of the media path 6.

Figure 3:
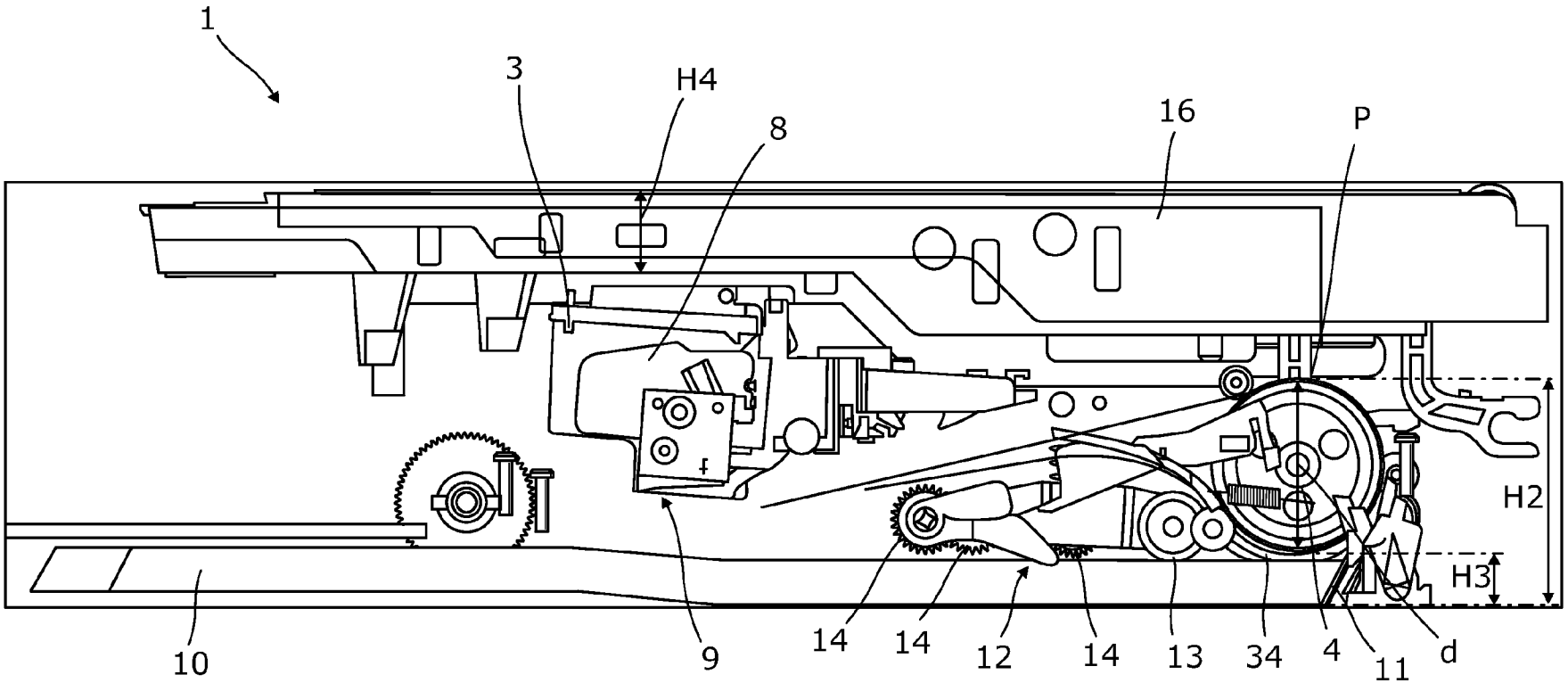
FIG. 3 shows another example of a printer in a cross sectional side view.

FIG. 3 shows another example of a printer 1 in cross sectional side view. The printer 1 includes a media input 2 (not shown in this figure). A media stack 10 is placed on the media input 2. For example, a space between the turn roller 4 and the media input 2 is determined so as to allow stacks of approximately 80 20 lb media sheets. The media input 2 is arranged so that media that is inserted in the printer 1 extends partly under the turn roller 4. A pickup ramp 11 is provided at the end of the media input 2. In the example, the media extends up to the pickup ramp 11. In an example, the inclination of the pickup ramp 11 may be approximately 50° or more, or approximately 60° or more with respect to the media input direction A. One example of an angle of the pickup ramp 11 with respect to the media input direction A is approximately 63°.

The printer 1 is provided with a pickup assembly 12. The pickup assembly 12 includes a pickup wheel 13. At least one gear 14 may be provided for rotation of the pickup wheel 13. The pickup wheel 13 may comprise a friction surface, for example an elastomeric surface, for providing friction between the pickup wheel 13 and the media. Rotation of the pickup wheel 13 may advance a leading edge of the media upwards along the pickup ramp 11 towards the turn path 6A.

In the shown example, the printer 1 includes a scanner assembly 16. The scanner assembly 16 is arranged on top of the print head carrier structure 8, on the opposite side of the turn roller 4 and print head carrier structure 8 with respect to the media input 2. The scanner assembly 16 may include a housing, a cover or lid, a glass plate and a scanning image sensor. In one example the height H4 of the scanner assembly 16, as measured above the print head carrier structure 8, is approximately 3 centimeters or less, or approximately 2.5 centimeters or less, for example including the cover. A further example scanner assembly 16 has a height H4 of approximately 2 centimeters, including the cover.

In the shown example, the print head carrier structure 8 is arranged to hold a print head 3 that is arranged to be exchanged. The nozzle plate 9 extends below the highest point P of the media path 6. The highest point P of the media path 6 is provided at the top of the turn roller 4.

Figure 4:
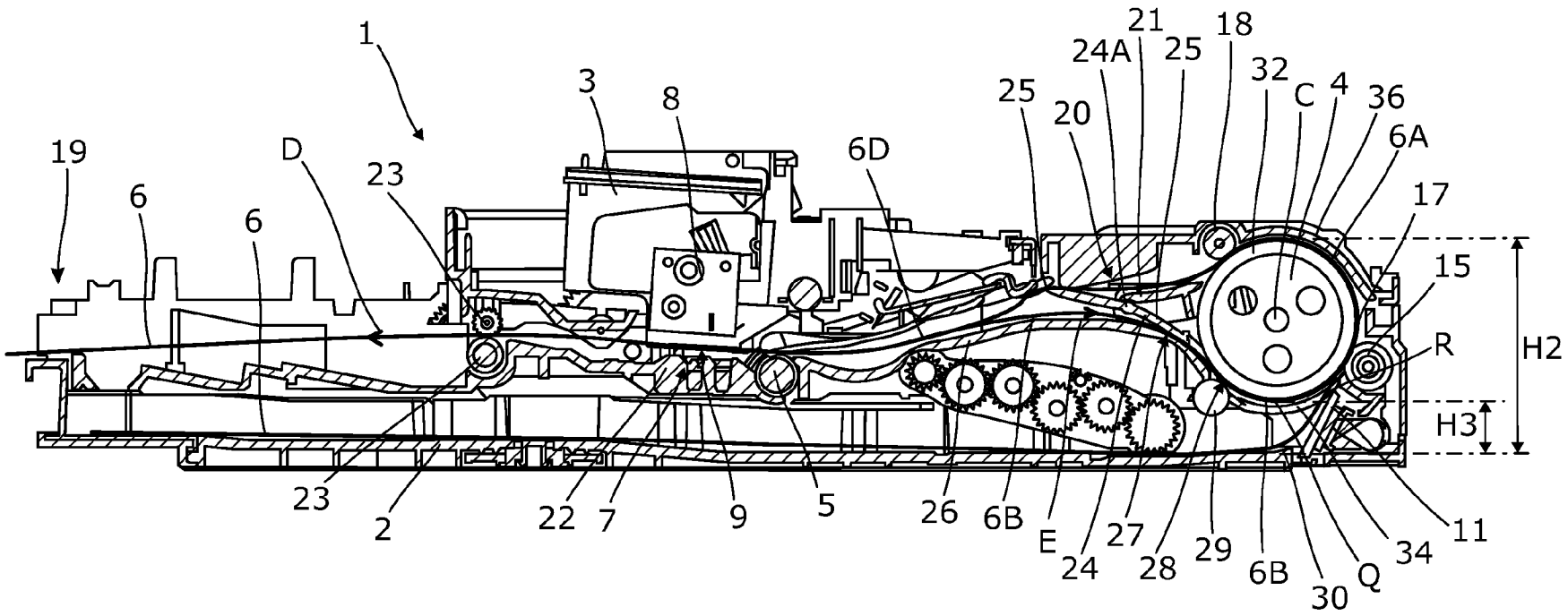
FIG. 4 shows another illustration of the example of FIG. 3 in a cross sectional side view.

FIG. 4 shows a different cross sectional side view of the example printer 1 of FIG. 3. Also the media path 6 is indicated. The media path 6 includes a duplex media path portion 6B. As can be seen, the media input 2 extends along substantially the full length of the printer 1. The media input 2 is tray shaped. In the shown example, the turn roller 4 is arranged above the media input 2. The pickup ramp 11 is arranged at the end of the media input 2. The turn roller central axis C extends above the media input 2, and next to the pickup ramp 11. The pickup ramp 11 is arranged below and on the far side of the turn roller 4 with respect to the media input and output. In the shown example, the top R of the pickup ramp 11 is higher than the bottom Q of the turn roller 4, as measured with respect to the bottom of the printer 1. The pickup ramp 11 is arranged to curve a leading edge of the media towards a nip 17 between a first wheel 15 and the turn roller 4, for advancing the media along the media turn path 6A. For example, the inclination of the pickup ramp 11 may be approximately equal to a tangential of the turn roller surface in or near the nip 17 between the first wheel 15 and the turn roller 4. The first wheel 15 may be a pinch wheel and/or a retard roller. The pinch wheel and/or retard roller may provide a retard force to separate a top sheet from lower sheets.

The turn roller 4 may be provided with an outer surface 32 that is arranged to provide friction between the turn roller 4 and the media. The outer surface may include elastomeric material. In an example, the turn roller 4 comprises multiple parallel turn wheels arranged to rotate around the central axis C, and arranged along the width of the central axis C.

A second wheel 18 is arranged downstream of the first wheel 15, for pinching the media between the second wheel 18 and the turn roller 4. In the shown example, the second wheel 18 is arranged at an angular distance of more than 90° with respect to the first wheel 15. In the shown example, the media is pressed against the turn roller 4 by the first wheel 15 and the second wheel 18. In the shown example, a turn wall 36 is provided between the first and second wheel 15, 18, for curving the media along the turn roller 4 between the wheels 15, 18. In an example, the media turn path 6A for turning the media is defined by the turn roller 4, the first wheel 15, the second wheel 18 and the guide wall 36.

The print head carrier 8 is arranged above the media input 2. In an example, the print head carrier 8 carries a replaceable print head 3. The print head carrier structure 8 is arranged within the printer 1 so that the nozzles of the nozzle plate 9 extend below a highest point P of the turn roller 4. A print zone 7 extends below the nozzle plate 9.

The printer 1 includes a guide structure 20. In one example, the guide structure 20 is arranged to guide unprinted media away from the turn roller 4 towards the print zone 7 for printing. In the shown example, the guide structure 20 includes at least one guide wall 21 over which the media slides towards the print zone 7. In an example, the multiple turn wheels of the turn roller 4 may extend partly into indents in the guide wall 21 so that a leading edge of the media lands on the guide wall 21. A part of the guide wall 21 may define a down slope media path portion 6D. A bottom guide wall 26 may function as a support and guide for both simplex and duplex media advancement. The printer 1 includes a guide wheel 5 for guiding and advancing the media from the guide structure 20 to the print zone 7. A print platen 22 may be provided at the print zone 7 for supporting the media at the print zone 7. Further pinch wheels 23 and/or guide elements may be provided downstream of the print zone 7 for advancing the media out of the printer 1.

In an example, the printer 1 is arranged for duplex printing. In the shown example, the turn roller 4 is also a duplex roller. For duplex printing, the media is turned along the same media turn path 6A as for simplex printing. Also the portion of the media path 6 that follows after the media turn path 6A may be the same. For example, the down slope portion 6D, the print zone 7 and the media output path 6E may be the same for duplex printing as for simplex printing.

The guide wheel 5 may function as a reverser for reversing the movement direction of the media after printing. For example, the guide wheel 5 may also facilitate de-skewing of the media. For example, also the further pinch wheels 23 may be arranged to change rotation direction for duplex printing. The guide structure 20 is arranged to guide the reversed media along the bottom side of the guide structure 20, towards the turn roller 4 for turning the media along the media turn path 6A for duplex printing. In the shown embodiment, the guide structure 20 includes a diverter 24. For example, the diverter 24 is arranged to rotate between a simplex or duplex position. The diverter 24 may rotate around an axis 24A so that its end 25 moves up for guiding the reversed media along the duplex media path 6B, and the diverter 24 may rotate around the axis 24A so that its end 25 moves down for guiding the media towards the print zone 7.

The duplex media path 6B may extend under the diverter 24 and under the rest of the guide structure 20. A nip 27 may be provided between the bottom guide wall 26 and the diverter 24 for guiding the media towards a duplex nip 28. In the shown example, the printer 1 includes a third pinch wheel 29 for pinching the printed media between the third pinch wheel 29 and the turn roller 4 for duplex printing, forming said duplex nip 28. Also, a second duplex guide wall 34 may be provided near the bottom Q of the turn roller 4 for guiding the media along the bottom of the turn roller 4, for example above the media stack 10. In the shown example, the second duplex guide wall 34 is curved and encloses a space between the turn roller 4 and the second duplex guide wall 34 for guiding the media.

The printer 1 may include a take-off ramp 30. The take off ramp 30 is arranged to incline the media before the pickup ramp 11. The take off ramp 30 has a smaller inclination than the pickup ramp 11, to assist the media in advancing along the pickup ramp 11. In one example, a leading edge of media in the media input 2 is supported by the take off ramp 30, before being picked up for printing. In an example, the inclination of the take-off portion 30 may be approximately 20° or less with respect to the media input direction A.

The diameter d of the turn roller 4 may largely define the height H2 of the media path 6. In addition to the diameter d of the turn roller 4, the total media path height H2 may include a height H3 of the bottom Q of the turn roller 4 with respect to the media input's surface. In one example, the height H3 of the bottom B of the turn roller 4 largely corresponds to a chosen maximum media stack height, as is diagrammatically illustrated in FIG. 3. In a further example, the height H3 of the bottom 37 of the turn roller 4 also includes a distance created by the duplex media path 6B, between the media stack 10 and the turn roller 4, for allowing passage of the media duplex media. The distance created by the duplex media path 6B may include the second duplex guide wall 34 and the space between the turn roller 4 and the second duplex guide wall 34 for passage of the duplex media. Hence, in one example a maximum total media path height H2 is defined by the distance between the media input 2 and the top P of the turn roller 4. The media path height H2 may be a sum of the turn roller diameter d, a predetermined maximum media stack height, a height of the second duplex guide wall and a height of the space between the turn roller 4 and the second duplex guide wall 34. For example, the height H2 of the media path 6 may be approximately 52 millimeter if the diameter d of the turn roller 4 is approximately 38 millimeter and the media stack height is approximately 10 millimeter and the space consumed by the duplex path 6B and that is included in the total media path height H2 is approximately 3.5 millimeter. Of course, different height ranges may apply. For example, the media path height H2 is approximately 6.5 cm or less, or approximately 5.5 cm or less, depending on the chosen diameter d of the turn roller 4 and/or the chosen media stack height and/or the space consumed by the duplex media path 6B. For example, the chosen media stack height may be between 3 and 20 millimeters. For example, the space consumed by the duplex media path 6B and the second duplex guide wall 34 may be between approximately 1 and approximately 10 millimeter.

Figure 5:
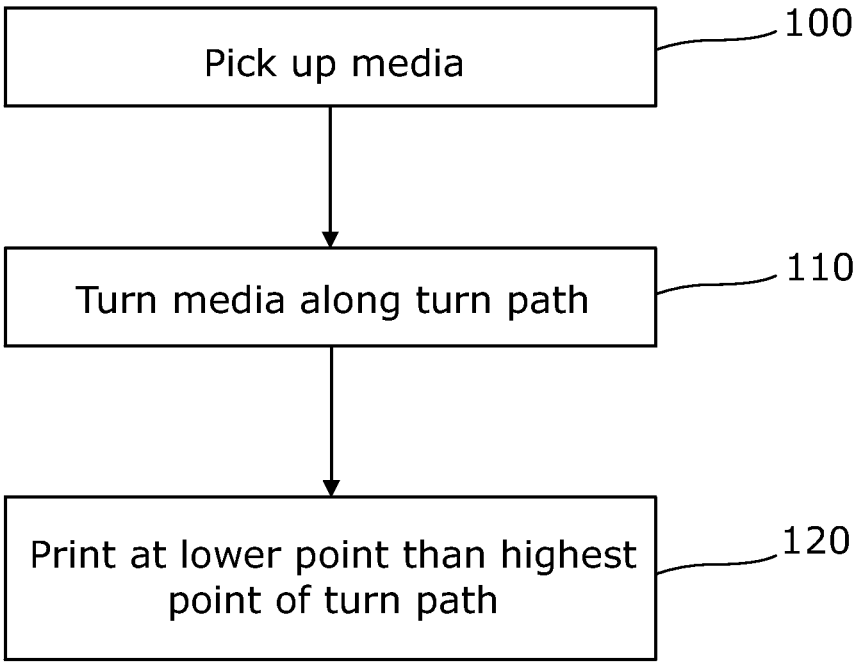
FIG. 5 shows a flow chart of an example of a print method.

FIG. 5 shows a flow chart of an example of a print method. The example print method includes picking up media, for example unprinted media (block 100). The example print method includes turning the media along a turn path 6A (block 110). The example print method further includes ejecting fluid onto the media at a lower position P2 than the highest point P of the media path 6 (block 120).

Figure 6:
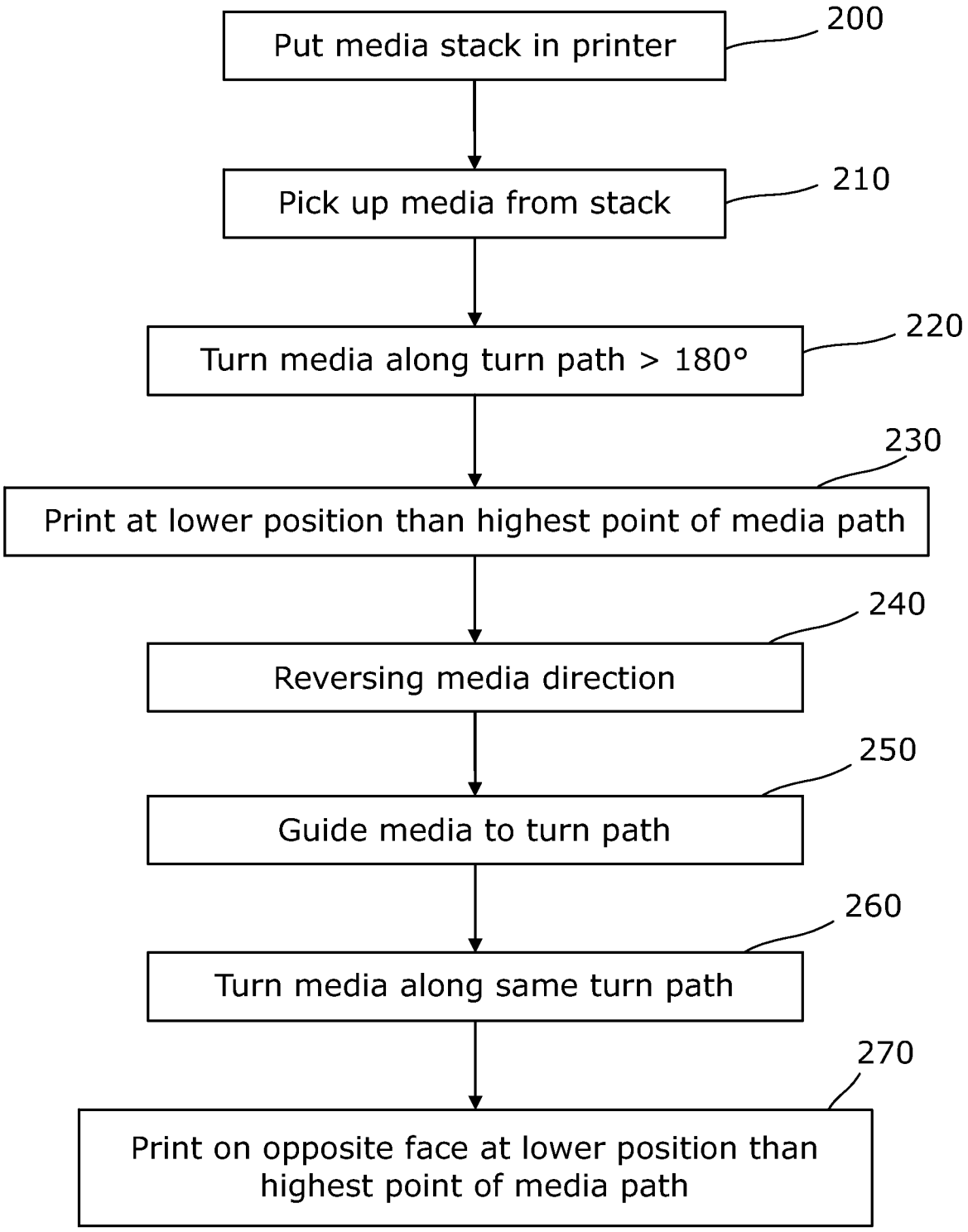
FIG. 6 shows a flow chart of another example of a print method.

FIG. 6 shows a flow chart of another example of a print method. In an example, the print method includes putting a media stack 10 in a printer 1 (block 200). For example, one or more media sheets are put in the media input 2 so that their respective leading edge extends partly below the turn roller 4. For example, one or more media sheets may engage the media pick up ramp 11 in an input position. In a further example, the print method includes picking up the media from the media stack (block 210). For example, the upper media sheet is pushed towards the pickup ramp 11 by rotation of the pickup wheel 14, so that the leading edge slides upwards along the pickup ramp 11, at least until it reaches the respective nip 17 and is taken along by the turn roller 4 and/or the first wheel 15.

In an example, the print method includes turning the media over an angle of more than 180° with respect to the media orientation in the input (block 220), to turn the media and lower it to a lower printing position P2. For example, the media is turned over an angle of more than 181°, or more than 190°. After the turn roller 4, the media may be turned downwards, along a part of the media turn path 6A and/or the down slope portion 6D. In an example, the diverter 24 directs the media towards the print zone 7. The media is then printed at a lower position P2 than the highest point P of the media path 6 (block 230). For example, fluid such as ink is ejected onto a first face of the media, through nozzles of the nozzle plate 9, the nozzle plate 9 extending below said highest point P.

After the first face is printed, the media advance direction D may be reversed for duplex printing, to a duplex media advance direction E (block 240), for example with the aid of at least one guide wheel 5. What was the leading edge during printing will be the trailing edge after the reverse action. The printed media is guided to the turn path 6A (block 250), for example by the guide structure 20. For example, the diverter 24 directs the media downwards to the duplex nip 28, along the turn roller 4 and the duplex guide wall 34.

The printed media is turned again along the media turn path 6A (block 260). The media may be turned again over an angle of more than 180°. The printed media may advance again over the down slope portion 6D and the print zone 7, with the printed face facing downwards. The printed media is then printed on the opposite face with respect to the first face, again at a lower position P2 than the highest point P of the media path 6 (block 270). Thereafter, the duplex printed media may be output in a media output direction D.

In an example of this disclosure, a printer 1 is provided, including a media path 6 arranged so that during printing the media (i) starts with an input orientation, (ii) turns along the media turn path 6A, over a highest point P of the media path 6, and (iii) moves towards the print zone 7 to a printing position P2 in the print zone 7, below said highest point P. For example, the media path 6 comprises a duplex media path portion 6B arranged so that for duplex printing the media (i) reverses its advance direction (D, E) after printing on the first face, (ii) turns again along the same turn path 6A, and (iii) moves towards the print zone 7 in the printing position P2, below the highest point P, with the opposite face of the media facing the print head 3.

For example, a relatively low profile media path 6 as described above may allow for a printer 1 having functionalities such as inkjet printing, simplex printing, duplex printing, copying and/or scanning while having a relatively low profile with respect to conventional printers having the same functionalities.

It is noted that in this description words such as "down", "downwards", "low", "lower", "high", "highest", "flat", etc. are used for reasons of illustration. However, this should not be considered as limiting the media path orientation and printer components orientation. The media path and/or multiple components may have any suitable orientation with respect to the surface on which the printer 1 is placed and/or with respect to the printer housing. For example, the printer 1 may be placed on its side and/or on its bottom and/or on its rear.

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfill the functions of several items recited in the disclosure, and vice versa several items may fulfill the function of one unit. Multiple alternatives, equivalents, variations and combinations may be made without departing from the scope of this disclosure.

The invention claimed is:

1. A print method comprising picking up media, turning the media along a turn path using a turn roller to define a curve of the turn path, the turn roller having a diameter substantially equal to a diameter of the turn path curve, and ejecting fluid onto the media at a lower point than a highest point of the turn path.

2. The print method according to claim 1, further comprising reversing a media advance direction of printed media, turning the printed media again along the turn path, and printing on an opposite side to a printed side of the printed media at a lower position than the highest point of the turn path.

3. The print method according to claim 1, wherein a height of a total media path of the media in the printer is approximately 6 centimeters or less, the total media path height being greater than the diameter of the turn roller.

4. A fluid ejection printer comprising a media path arranged so that during printing, a media starts with an input orientation, turns along a turn path, over a highest point of the media path, and moves towards a print zone to a position below the highest point to be printed, wherein the turn path has a curve defined by a diameter of a turn roller used to turn the media along the turn path.

5. The fluid ejection printer according to claim 4, wherein the media path comprises a duplex media path portion arranged so that for duplex printing, the media reverses movement direction after printing, turns again along the same turn path, moves towards a print head in a printing orientation, below the highest point, with an opposite side facing the print head as compared to a side of a previous printing orientation of the same media.

* * * * *